United States Patent [19]

Kober

[11] 4,094,298

[45] June 13, 1978

[54] SEPARATOR IN ELECTROCHEMICAL HEATING ELEMENT

[75] Inventor: Frederick P. Kober, Bayside, N.Y.

[73] Assignee: Chem-E-Watt Corporation, Racine, Wis.

[21] Appl. No.: 743,187

[22] Filed: Nov. 19, 1976

[51] Int. Cl.[2] ..... F24J 1/04

[52] U.S. Cl. ..... 126/263; 132/36.2 B

[58] Field of Search ..... 126/263; 429/8, 120; 62/3; 132/36.2 B; 204/197

[56] References Cited

U.S. PATENT DOCUMENTS

| | | | |
|---|---|---|---|
| 3,207,149 | 9/1965 | Spindler | 62/3 X |
| 3,229,469 | 1/1966 | Katon | 62/3 |
| 3,307,997 | 3/1967 | Detrick | 126/263 X |
| 3,623,471 | 11/1971 | Bogue | 126/263 |
| 3,774,589 | 11/1973 | Kober | 126/263 |
| 3,884,216 | 5/1975 | McCartney | 126/263 X |

*Primary Examiner*—Ronald C. Capossela

[57] ABSTRACT

An improvement in the separator layer of an electrochemical heating element having two electrode layers, a separator layer of porous, absorbent material therebetween, and electrically conductive connector means extending through the electrode and separator layers. The improved device includes structural spacing means interposed between one of the electrode layers and at least a portion of the other electrode layer to limit compression of the separator layer material. In one embodiment, discrete mechanical spacers are placed immediately adjacent to the connector means. In another embodiment, a recessed surface portion is formed in one of the electrode layers and the adjacent separator layer has a mating portion on one side which is received into the recessed surface portion.

11 Claims, 6 Drawing Figures

SEPARATOR IN ELECTROCHEMICAL HEATING ELEMENT

BACKGROUND OF THE INVENTION

This invention relates to electrochemical heat-generating elements, and, in particular, to improvements in uniformity and performance reproducibility in such elements.

The prior art as taught by Kober in U.S. Pat. No. 3,774,589 described an electrochemical heater element having an anode layer and a cathode layer and a suitable porous, highly absorbent separator means situated therebetween, the electrode layers being connected one to another internally by electrically conductive short-circuiting members, such as staples and the like. Introduction of a suitable electrolyte into this construction initiates an electrochemical heat-producing reaction.

It has been shown on theoretical grounds that this heater construction results in efficiencies of energy conversion, (that is, the conversion of the chemical energy inherent in the electrochemically active materials to thermal energy) approaching 100%. However, in practice, although the energy conversion reaction proceeds at an efficiency approaching 100%, reproducibility in the total heat output and output pattern is well below acceptable levels unless extreme care is taken during the manufacturing of these elements. Such extreme care and unreasonably close tolerances during manufacture are both time-consuming and costly. This problem applies to heating elements of the type disclosed in U.S. Pat. No. 3,774,589, and a new heat generating element which is disclosed in a concurrently filed, co-pending patent application of Frederick P. Kober entitled COMPLEX ELECTROCHEMICAL HEATING ELEMENT.

Experimentation has shown that this less than acceptable level of reproducibility can be attributed to a non-reproducible compression of the absorbent separator material contained within the electrochemical heat producing element. Unless separator compression is eliminated or, at best, limited, the heat generating element absorbs varying quantities of activating fluid, that is, either water or an electrolyte solution, during activation. Furthermore, if the separator is compressed and held mechanically beyond a certain limit, the electrolyte which is absorbed is not able to distribute or wick uniformly throughout the heater structure. Hence, the heat generating reaction has a tendency to progress non-uniformly across the element with the result of less than maximum utilization of the available active materials.

In short, this non-reproducible compression of the separator material occurring in normal assembly of the electrochemical elements results in a changing internal volume (from element to element) available for the absorption of electrolyte during activation. And, particularly if this separator compression is held beyond a certain limit, the absorbed electrolyte is not distributed uniformly throughout the heat-producing element.

It has been demonstrated experimentally that, for simple electrochemical heating elements of the type disclosed in U.S. Pat. No. 3,774,589, using standardized anode layer, cathode layer and separator layer stock, and standard electrolyte concentrations, a minimum volume of electrolyte solution per square inch of heater element is required to insure efficient, reliable activation and to achieve maximum conversion of the active material to thermal energy. The minimum required volume of electrolyte has been determined to be on the order of 1.5cc per square inch of heater element for the standardized elements tested. Experience has shown, however, that, for a maximum rate of heat generation and maximum production of total heat, at least about 1.67cc of electrolyte solution per square inch of heater should be used. Substantial additional amounts of electrolyte solution above this minimum required volume do not significantly affect overall heater element performance. It has been found that an electrolyte volume in the range of about 1.67 to 2.4cc per square inch of heater element is effective. If an electrolyte volume much above about 2.4cc per square inch were used, the overall rate of heat generation would be diminished due to the larger mass of internal liquid to be heated.

These minimum volumes of electrolyte are all above that required stoichiometrically to sustain the electrochemical heat-generating reaction. But such minimum volumes of electrolyte appear to be necessary: (1) to assure uniform wetting and distribution of the liquid throughout the heater structure, and (2) to provide sufficient electrolyte solution for the hydrolysis reaction(s) which accompany and probably compete with the electrochemical reaction. Regardless of the exact reasons, however, the heat-generating structure must be capable of absorbing at least a minimum required volume of electrolyte for it to function efficiently and reproducibly.

In an attempt to improve the electrolyte capacity and increase the ease of reproducing performance characteristics of electrochemical heating elements of the type disclosed in U.S. Pat. No. 3,774,589, one might consider using a substantially thicker layer of separator material or a multi-layered separator. However the use of a thicker or multi-layered separator results in an increase in internal resistance of the heater element, causing a decrease in the rate of heat generation. Further, the use of a thicker or multi-layered separator does not substantially reduce or eliminate the problem of separator compression.

Thus, there has been a need for an electrochemical heat-generating element having good reproducibility of performance and having substantial capacity for an electrolyte solution in its separator layer.

BRIEF SUMMARY OF THE INVENTION

The present invention is an improvement in electrochemical heat-generating elements of the type having at least two electrode layers, including an anode of electrochemically active, electrically conductive, oxidizable material and a cathode of electrochemically active, nonmetallic, reducible material, a separator layer of porous, absorbent material between the electrode layers, and electrically conductive connector means extending through the electrode and separator layers. The improvement relates to a structural spacing means interposed between one of the electrode layers and at least a portion of the other electrode layer whereby to limit compression of the separator layer.

In one embodiment, the structural spacing means includes discrete mechanical spacers placed immediately adjacent to the connector means between the electrode layers. Also disclosed are variations of this embodiment. In another principal and highly preferred embodiment, the structural spacing means includes one of the electrode layers being formed to define a recessed surface portion and the adjacent separator layer having a mating (or "wick") portion formed on one side and received into the recessed surface portion of the electrode layer. Variations of this embodiment are also disclosed and claimed.

A substantial improvement in reproducibility of performance characteristics and elimination of undue separator compression are obtained by using the aforementioned discrete mechanical spacers. Such spacers may take the form of small planar pads which are situated between the separator material and one or both of the electrodes and pierced through by the electrically conductive connector means such as staples. The area of such pads in comparison with the area of the heating element is negligible. However, the interposition of such pads within the heating element structure reduces the pressure of the electrode layers on nearly all of the surface of the separator layer by applying the pressure through the spacers. Other sorts of mechanical spacers, including small metal eyelets and a great variety of other configurations of metallic or electrically inert materials, can be used to advantage. By using such mechanical spacers, much of the separator compression is eliminated and the retained electrolyte volume can be controlled within much closer tolerances. In this way, heat output can be maximized with excellent reproducibility from heater to heater.

While the use of such mechanical spacers has proven effective, there may be certain difficulties in properly and reproducibly placing such spacers. Accordingly, an important alternate embodiment of this invention is the inventive "recessed" structure described and claimed herein. In such embodiment, at least one of the electrode layers is formed to define a recessed surface portion which may be centrally located on the surface of such electrode layer. Such recessed surface is preferably formed in the cathode layer. The adjacent separator layer has an additional built-up portion, either added to or formed with the basic portion of the separator layer, which mates with the recessed surface portion of the electrode layer. The electrically conductive connector means, such as staples, extend through the heating element in surface areas away from the recessed and mating portions.

By virtue of this configuration, the mating portion of the separator layer can function as a wick for the separator layer, assuring that sufficient electrolyte solution is available. The recessed portion and mating portion (or wick) may be in a variety of shapes and sizes. Preferably the wick is within the range of about one-eighth to one-half of the width of the heat-generating element and most preferably on the order of about one-third the width of the element. However, it may be appreciated that a variety of sizes and shapes are operable and in some cases a multiplicity of wicks and a multiplicity of recessed portions would be acceptable.

As already indicated, it is preferred that the recessed surface portion be formed in the cathode layer. However, the anode layer may be used for this purpose as well, although the performance which has been achieved in such structures has not been as dramatic as that derived from the preferred arrangement. In simple electrochemical heating elements, having one anode layer, one cathode layer and a separator layer, both the anode and cathode can be formed with a recessed portion. However there appears to be little if any additional advantage achieved with such a configuration. In complex elements having two cathode layers, two separator layers, and a center anode layer in a sandwich-like structure, each cathode layer may be formed to have a recessed surface portion and the adjacent separator layers may be formed with appropriate mating portions to provide a wicking structure for each separator.

The highly preferred embodiments having the wick structure provide excellent reproducibility in performance from element to element. Furthermore, cost advantages are realized in production since special manufacturing procedures and extremely close tolerances may be eliminated. Even if the basic separator material, around the mating or wick portion, becomes compressed during assembly, the uncompressed electrolyte resevoir provided by the wicking structure is available to absorb the necessary quantity of electrolyte and distribute such electrolyte uniformly throughout the heater.

The benefits and advantages derived from this invention, and, in particular, from the most preferred embodiment including the wicking structure, are especially important for electrochemical heating elements requiring a high rate of heat generation, sustained heat output over an extended period of time (for example, 20 minutes or longer), uniform heat generation per unit area of heater element, and/or rapid reliable activation. Elements designed for such performance have a generally higher sensitivity to variations caused by normal manufacturing procedures.

Comparative data illustrating the advantage of reproducibility provided by this invention will be given hereafter.

OBJECTS OF THE INVENTION

One object of this invention is to overcome the aforementioned problems and shortcomings in electrochemical heating elements of the prior art.

Another object of this invention is to provide electrochemical heating elements which are substantially uniform in performance.

Another object of this invention is to provide an electrochemical heating element which may be manufactured with normal manufacturing procedures without concern for extremely close tolerances.

Yet another object of this invention is to provide an electrochemical heating element in which there is a high utilization of electrochemically active materials.

These and other important objects of the invention will be apparent from the following description of preferred embodiments and the discussion relating thereto.

DETAILED DESCRIPTION OF PREFERRED EMBODIMENTS

Figure 1:
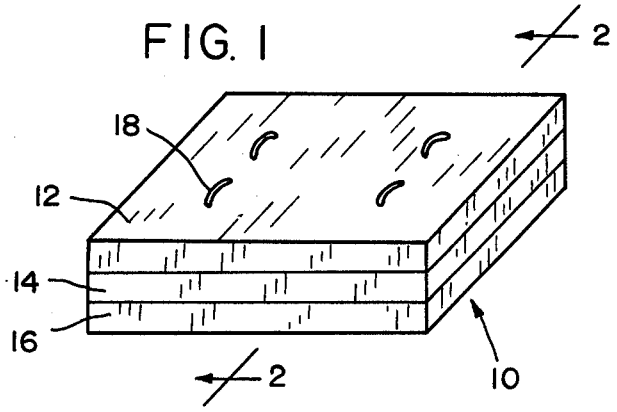
FIG. 1 is a perspective view of an electrochemical heating element according to this invention.

In the drawings, showing different preferred embodiments of this invention, like numerals designate like parts.

FIG. 1 is a perspective view showing an electrochemical heating element 10 according to this invention. Element 10 has three layers including a cathode layer 12, an adjacent separator layer 14, and an anode layer 16 adjacent to separator layer 14. Each layer is in intimate contact at its surface with the surface of the adjacent layers, this holding true for both surfaces of separator layer 14.

Cathode layer 12 includes an electrochemically active, nonmetallic, reducible substance which is conductive. Cathode layer 12 need not be formed of a reducible substance but may provide an electrochemically active surface upon which another material, for example, oxygen on an activated carbon-air electrode, is reduced. Cathode materials may be formed of a wide variety of substances such as manganese dioxide, metadinitrobenzene, silver chloride, silver oxide, copper fluoride, copper chloride and air depolarized cathode structures of the carbon and metal type.

The material for anode layer 16 can be selected from those metals and alloys which are known to be electrochemically active, for example, zinc, aluminum, magnesium, cadmium, lead, or alloys thereof. Anodes of aluminum and magnesium or their more common alloys are preferred because of their high inherent energy content and lack of concern for toxicity. The anode structure can take the form of thin metallic sheets or foils, powders, chips, granules or turnings pressed or rolled into a suitable conductive plate.

Separator layer 14 is formed of a non-conductive, porous, absobent material such as cotton, felt, or bibulous papers, which enable ions of an electrolyte to freely pass between the anode layer and the cathode layer. The separator material is sized to absorb and hold a sufficient amount of electrolyte solution between the electrodes to sustain the high rate electrochemical reaction to completion.

An electrolyte formed of an ionically conductive medium is placed within separator layer 14. The electrolyte may be an aqueous salt solution such as table salt (NaCl), or may be selected from a host of many other well known electrolyte materials. In those applications for which extremely high heat output is essential, highly acid or alkaline electrolytes can be used to great advantage. For example, water can be used in combination with a lithium metal anode, the electrolyte being lithium hydroxide which is produced spontaneously upon contact of the water with the lithium. This extremely high energy reaction could find use where high heat output per unit weight and area of heater is required. However, for the wide range of more common potential applications for the electrochemical heater, electrolytes consisting of an aqueous solution of sodium or magnesium chloride are preferred.

An electrolyte solution may be introduced into separator layer 14 in a number of ways. An electrolyte salt may be contained within the separator material in dry form, which when contacted with water dissolves to form the aqueous electrolyte solution. Alternatively, the dry salt can be intermixed or dispersed within the cathode or anode active materials. In both such cases, the activation of the heater element is by simple introduction of water and subsequent dissolving of the dry salt to form an electrolye within the separator material. Or, an aqueous electrolyte solution can be used directly for heater activation, that is, without any dry salt contained within the heater structure. Combinations of the above can also be used to good advantage. The placement of dry electrolyte salt within the heater, and activation with water or salt solution is governed by the speed at which it is desired for the reaction to initiate. For example, if a salt solution is used for heater activation the electrochemical reaction is initiated essentially instantaneously. On the other hand, if water is used for activation, the dry salt contained within the heater element must first dissolve before the electrochemical reaction can begin generating heat at the desired rate.

Figure 2:
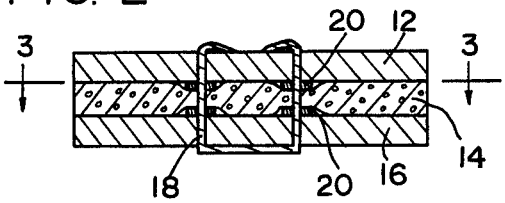
FIG. 2 is a side sectional view of FIG. 1 taken at section 2—2 as indicated in FIG. 1.
Figure 3:
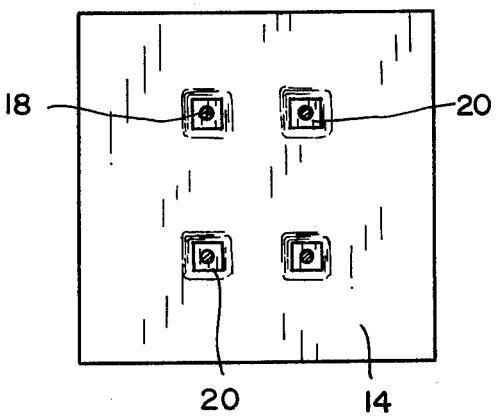
FIG. 3 is a top sectional view taken at section 3—3 as indicated in FIG. 2.

As illustrated best in FIGS. 2 and 3, electrically conductive connector means 18 extend through the three-layered element, electrically connecting anode layer 16 and cathode layer 12 through separator layer 14. Connectors 18 are sized to support the short-circuiting current produced when the electrochemical heating element is activated. Connectors 18, which are integrally contained as part of the element, serve a dual purpose: 1) holding the overall heater sandwich structure together — keeping the individual layers in proper juxtaposition to one another, and 2) providing an internal short-circuiting means between the anode and cathode structures. Consequently, the fastening means must be mechanically strong while at the same time being electrically conductive. The fastening means may be selected from metal rivets, metal wire or staples, conductive carbon thread or similar materials. From the standpoint of heater performance, economics and ease of production, metal wire or staples are preferred.

Interposed in the plane between cathode layer 12 and separator layer 14, and separator 14 and anode layer 16 are structural spacing means in the form of discrete mechanical spacers 20, which are placed immediately adjacent to connectors 18. Spacers 20 are in the form of small, electrically inert, square pads which having been placed in the appropriate location and pierced by connectors 18 as connectors 18 interconnect layers 12, 14 and 16. Spacers 20 may be made of plastics, paper, cardboard, rubber, and a wide variety of other materials. Spacers 20 need not be electrically inert. A wide variety of metallic and nonmetallic materials would be suitable. Electrically inert materials are preferred since such could not interfere in any way with the short-circuiting function provided by connectors 18 in electrochemical heating element 10.

As is best illustrated in FIG. 3, spacers 20 cover an essentially negligible portion of the surface area of element 10. Spacers 20 serve to concentrate and focus the compression, caused by the interconnection of the layers, on specific points eliminating the more even distribution of compression across the element which can substantially interfere with the absorptive capacity of separator layer 14.

Figure 4:
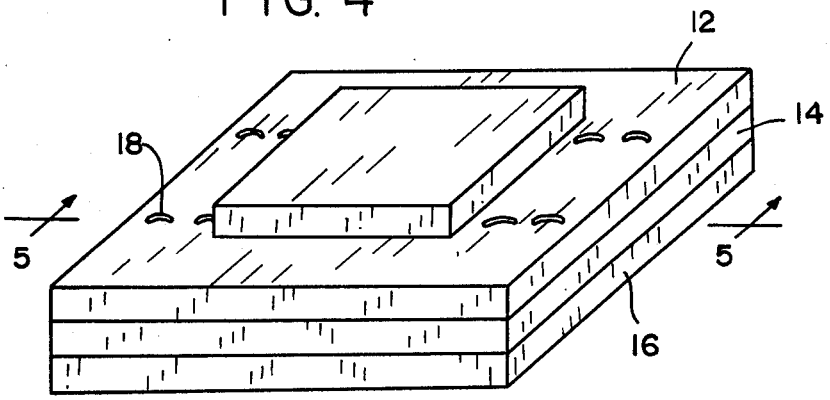
FIG. 4 is a perspective view of a preferred alternate embodiment of the invention.
Figure 5:
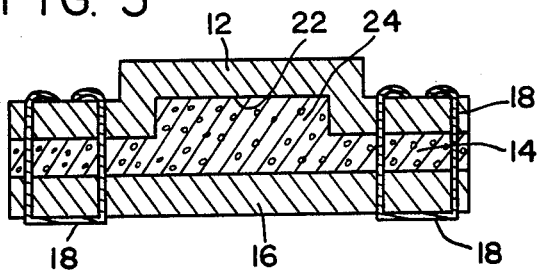
FIG. 5 is a sectional view of FIG. 4 taken at section 5—5 as indicated in FIG. 4.

FIGS. 4 and 5 illustrate a highly preferred embodiment of this invention. The electrochemical heating element shown in these figures has cathode layer 12, separator layer 14, anode layer 16 and connectors 18 as in the previously described embodiment. However, the structural spacing means interposed between the electrode layers 12 and 16 includes cathode layer 12 being formed to define a recessed surface portion 22 as shown best in FIG. 5. Recessed surface portion 22 is in the form of a square recess centrally located on cathode layer 12 as illustrated in FIG. 4. Separator layer 14 includes a mating or wick portion 24 on its upper surface, as shown in FIG. 5, which is shaped to be approximately complementary to recessed surface portion 22 of cathode layer 12. Mating or wick portion 24 is received into recessed surface portion 22.

Connectors 18 are placed through the heating element in areas adjacent recessed surface portion 22 and mating or wick portion 24. Wick 24, by virtue of the recessing of a portion of cathode layer 12 and the positioning of connector means 18, will remain substantially uncompressed. Therefore, wick 12 is able to absorb and hold an adequate amount of electrolyte solution during activation of the element. In effect, the wick structure stands "free" within the heater element assembly, although in contact with the recessed surface of cathode layer 12. It should be noted that for large sized heater elements the wick could be located or held in place with a staple or fastener, provided the bulk of the wick structure remains uncompressed.

Figure 6:
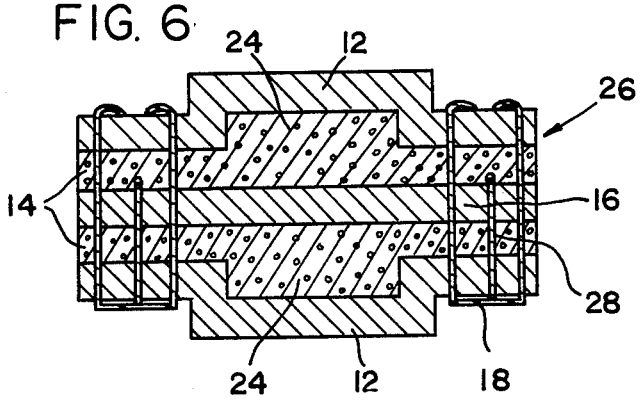
FIG. 6 is a similar sectional view of a related embodiment of this invention.

FIG. 6 illustrates a complex element 26 having five layers including two cathode layers 12 and two separator layers 14. Each adjacent cathode layer and separator layer are formed and operate in the same manner as the cathode and separator layer of the element illustrated in FIGS. 4 and 5. Complex element 26, however, has additional connector means 28 which connect one pair of adjacent cathode and separator layers with anode layer 16 in a subassembly which is later joined to the other pair of adjacent cathode and separator layers.

Experiments have shown that the wicking structure need not take the rectangular shape illustrated in FIGS. 4 through 6. Numerous other shapes and sizes have been evaluated and all have proven to be effective. Circular, trapezoidal, triangular and irregular shapes are examples. The rectangular wick illustrated in the drawings is preferred because of its ease of handling in production and its cost effectiveness in utilization of raw materials. A preferred variation of the rectangular wick illustrated in drawing FIGS. 4 through 6 is a recessed surface portion and mating portion which are rectangular but extend completely across the element in one direction, forming, in effect, a stripe thereacross.

In especially preferred embodiments, the recessed surface portion and mating portion are substantially centrally located on the heating element as shown in FIGS. 4 through 6. It is preferred that the width of such surface portion 22 and mating portion 24 be within the range of about one-eighth to one-half of the width of the heat-generating element and most preferred that it be on the order of about one-third of the width of the element, at least in one direction. The recessed surface portion and mating portion need not be centrally located. Other locations or a multiplicity of locations would be acceptable. However, the preferred centrally located wicking structure in the preferred size range has shown itself to be most advantageous in achieving efficient heat output and reproducibility thereof.

One practical application of this invention is the heating of pre-packaged food such as the type referred to as "retort" packaged food. The following data, determined by the actual heating of 5 ounce (142 g) portions of retort packaged food, will show the advantages and benefits of the most preferred embodiment of this invention, the electrochemical heating element including a wicking structure. In all cases, the food samples were temperature stabilized at 4° C (39.2° F), and the heater elements were activated using a 23.3% aqueous solution of sodium chloride. In developing these data, simple elements of the type illustrated in FIGS. 4 and 5 were utilized as well as simple elements having no wicking structure. In each case the elements had 9 sq in of surface area and 3.5 g magnesium foil anode layers. Total BTU output was measured for 15 minutes and 20 minutes.

The BTU outputs for 15 minutes ranged from 12–21 BTU without a wick and from 21–23 BTU with a wick. Over 20 minutes the improvement provided by the invention raised the BTU output range from 15–24 to 26–28.

These and other data show that the spread in experimental results is substantially reduced by use of the wick structure. It also illustrates that the total heat output may be substantially increased by use of the wick structure. Such reproducibility and increased heat output are extremely important in a wide variety of applications for electrochemical heat generating elements.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. In an electrochemical heat-generating element of the type having two electrode layers, including an anode and a cathode, a separator layer of porous, absorbent material therebetween, and electrically conductive connector means extending through said electrode and separator layers, the improvement comprising annular spacer means interposed between said electrode layers, said connector means extending through said annular spacer means, whereby to limit compression of said separator layer.

2. The improvement of claim 1 wherein said annular spacer means comprise a multiplicity of discrete spacers.

3. The improvement of claim 2 wherein said element has five layers including, in order, a cathode layer, a separator layer, an anode layer, a separator layer and a cathode layer, and wherein said discrete spacers are in each of said separator layers.

4. The improvement of claim 2 wherein said discrete spacers are made of electrically inert material.

5. The improvement of claim 1 wherein said anode comprises electrochemically active, electrically conductive, oxidizable material and said cathode comprises electrochemically active, nonmetallic, reducible material.

6. In an electrochemical heat-generating element of the type having two electrode layers, including an anode and a cathode, a separator layer of porous, absorbent material therebetween, and electrically conductive connector means extending through said electrode and separator layers, the improvement in which at least one of said electrode layers is formed to define a recessed surface portion, and said separator layer has a mating portion of one side thereof, said mating portion being received into said recessed surface portion.

7. The improvement of claim 6 wherein said recessed surface portion and said mating portion are substantially centrally located on said heating element.

8. The improvement of claim 7 wherein the width of said mating portion in at least one direction is within the range of about one-eighth to one-half of the width of the heat-generating element.

9. The improvement of claim 8 wherein the width of the mating portion in at least one direction is about one-third the width of said heat-generating element.

10. The improvement of claim 6 wherein said element comprises a five-layered structure including, in order, a cathode layer, a separator layer, an anode layer, a separator layer and a cathode layer, and wherein each of said cathode layers are formed to define a recessed surface portion and each of said separator layers have a mating portion on one side thereof received into each of said recessed surface portions, respectively.

11. The improvement of claim 6 wherein said anode comprises electrochemically active, electrically conductive, oxidizable material and said cathode comprises electrochemically active, nonmetallic, reducible material.

* * * * *